United States Patent [19]

Baba et al.

[11] Patent Number: 4,645,544

[45] Date of Patent: Feb. 24, 1987

[54] PROCESS FOR PRODUCING COLD ROLLED ALUMINUM ALLOY SHEET

[75] Inventors: Yoshio Baba; Shin Tsuchida, both of Nagoya, Japan

[73] Assignee: Sumitomo Light Metal Industries, Tokyo, Japan

[21] Appl. No.: 504,261

[22] Filed: Jun. 14, 1983

[30] Foreign Application Priority Data

Jun. 21, 1982 [JP] Japan ..... 57-105472

[51] Int. Cl.[4] ..... C22F 1/04

[52] U.S. Cl. ..... 148/12.7 A; 148/415; 148/417

[58] Field of Search ..... 148/11.5 A, 12.7 A, 148/415, 417, 439, 440

[56] References Cited

FOREIGN PATENT DOCUMENTS 52-105509 9/1977 Japan .

*Primary Examiner*—R. Dean

*Attorney, Agent, or Firm*—Handal & Morofsky

[57] ABSTRACT

The present invention relates to a cold-rolled aluminum-alloy sheet having a high strength and a good formability required for producing a DI can. The sheet according to the present invention contains 0.1–2.0% Mn, 0.1–2.0% Mg, and 0.1 to 0.5% Si, has a thickness of 0.4 mm or less. The present invention is characterized by holding a sheet to a temperature of from 80° to 150° C., when it is already heat treated at 400°–580° C. and it is not yet finally cold-rolled. The sheet according to present invention is finally cold-rolled and has a fine grain size.

6 Claims, No Drawings

PROCESS FOR PRODUCING COLD ROLLED ALUMINUM ALLOY SHEET

BACKGROUND OF THE INVENTION

1. Field of the Invention

The present invention relates to a cold-rolled aluminum alloy sheet for forming and a process for producing the same. More particularly, the present invention relates to a cold-rolled aluminum alloy sheet for forming which includes ironing, such as in the production of a drawing and ironing (DI) can, and to a process for producing the same.

2. Description of the Prior Art

When working aluminum, the most commonly used materials are pure aluminum and AA 3004-alloy. Pure aluminum offers excellent workability, but is low in strength. Therefore, AA 3004 alloy having H18 temper or H38 temper, which is satisfactory in both workability and strength, is used more frequently. A cold-rolled AA 3004 alloy sheet having H18 temper or H38 temper has a yield strength $\sigma_{0.2}$ of from 26 to 30 kg/mm$^2$ and a tensile strength $\sigma_B$ of from 29 to 31 kg/mm$^2$ with a cold-rolled degree of from 80% to 90%. If an attempt is made to enhance the rolling degree to more than 90% so as to further enhance the strength, the plastic deformation of the alloy is considerably lowered and the cold rolling becomes difficult.

A known aluminum alloy having a high magnesium content, such as stipulated in Japan Industrial Standard (JIS) 5056, has high strength and excellent corrosion resistance but rather poor formability. High strength heat-treatable aluminum alloys, such as duralmin, superduralmin, and extra super duralmin, all have high strength, the strength of extra super duralmin being the highest, but have poor corrosion resistance. In addition, although duralmin has good formability, the formability of super duralmin and extra super duralmin is poor.

The term "formability" used herein indicates the cold-working formability required by an aluminum alloy to be cold rolled into a sheet having as small a thickness as possible to produce a thin wall can and indicates the formability or shaping, such as drawing and ironing, required to shape a cold-rolled aluminum-alloy for forming (hereinafter simply referred to as a cold-rolled sheet for forming) into a can.

From the point of view of reducing the amount of aluminum alloys used, and thus saving natural resources, it is necessary to provide a can with a thin wall. In order for such a thin-wall can to have satisfactory strength, the aluminum alloy must therefore have high strength. Such formability and high strength have not been simultaneously possible with known aluminum alloys. Also, a can must clearly be resistive to corrosion due to its contents and to the ambient air and the like. Therefore, all the three properties, i.e., formability, strength, and corrosion resistance, must be combined in a cold-rolled sheet for forming.

Japanese Unexamined Patent Publication (Kokai) No. 52-105509 discloses a process for producing an aluminum-alloy sheet for drawing containing from 0.3% to 1.5% manganese, from 0.1% to 0.5% silicon, and from 0.3% to 3.0% magnesium. The disclosed process is characterized by successively subjecting the aluminum alloy to hot-rolling, initial cold-rolling at a cold-rolling degree of 60% or more, rapid heating to a temperature of from 500° C. to 600° C. followed by rapid cooling, final cold-rolling at a rolling degree of 10% or more, and finally low-temperature annealing at a temperature of from 100° C. to 250° C. The resultant cold-rolled sheet has an approximately 26 kg/mm$^2$ yield strength, approximately 3% elongation, approximately 1.5% earing percentage, and approximately 1.70 limiting drawing ratio (LDR).

SUMMARY OF THE INVENTION

It is an object of the present invention to provide a cold-rolled sheet for forming which has improved formability, strength, and corrosion resistance, especially strength, so as to attain thin wall articles.

It is another object of the present invention to provide a process for producing the cold-rolled sheet for forming mentioned above.

In accordance with the objects of the present invention, there is provided a cold-rolled sheet for forming. The sheet contains from 0.1% to 2.0% manganese, from 0.1% to 2.0% magnesium, and from 0.1% to 0.5% silicon as essential elements and has a thickness of 0.4 mm or less. The average diameter of grains of the sheet is 50 microns or less measured in the short width direction of the sheet. The final finishing condition of the sheet is cold rolling.

In accordance with the objects of the present invention, there is also provided a process which comprises the steps of: hot-rolling an aluminum-alloy ingot which contains from 0.1% to 2.0% manganese, from 0.1% to 2.0% magnesium, and from 0.1% to 0.5% silicon as essential elements; cold-rolling, if necessary; heat-treating, in which heating at a temperature of from 400° C. to 580° C. for a period of 5 minutes or less is followed by rapid cooling at a rate of 10° C./second or more down to a temperature of 150° C. or less; and finally cold-rolling at a rolling degree of 30% or more. The process also comprises, after the heat-treating step but not after the final cold-rolling step, a low-temperature holding step of holding the aluminum-alloy sheet to a temperature of from 80° C. to 150° C.

DESCRIPTION OF THE PREFERRED EMBODIMENTS

First, the alloying composition of the cold-rolled sheet for forming according to the present invention is described.

Manganese is necessary for preventing the cold-rolled sheet for forming from sticking to a tool during deep drawing and ironing. If the manganese content is less than 0.1%, the manganese is not effective for preventing sticking. If the manganese content exceeds 2.0%, coarse aluminum-manganese compounds are formed during casting. This would cancel out the effect of grain refinement of the cold-rolled sheet for forming and would adversely affect the deep-drawing and ironing formabilities enhanced by the working and heat-treating method according to the present invention.

Magnesium forms precipitates, if especially fine $Mg_2Si$ precipitates, which enhance the strength of the cold-rolled sheet for forming and contribute to the grain refinement. If the magnesium content is less than 0.1%, the strength is not satisfactory. If the magnesium content is more than 2.0%, the formability becomes low.

Silicon also forms precipitates, especially, fine $Mg_2Si$ precipitates, which contribute to enhancement of the strength of the cold-rolled sheet for forming. If the silicon content is less than 0.1%, the silicon cannot effectively strengthen the aluminum alloy. If the silicon content is more than 0.5%, the strength of the aluminum alloy is too high and the hot-rolling workability and the deep-drawing and ironing workability of the cold-rolled sheet for forming deteriorate.

In addition to the above, one or more of 0.1% to 0.4% copper, 0.1% or less chromium, 0.7% or less iron, 0.3% or less zinc, 0.15% or less titanium, 0.5% or less zirconium, and 0.01% or less boron may be used as an alloying element. When these elements are not deliberately used but are contained in the aluminum alloy as unavoidable impurities, their total content is 1.1% or less.

Copper effectively promotes the enhancement of strength due to silicon and manganese at a content of 0.1% or more. If the copper content exceeds 0.4%, however, the hot-rolling workability and corrosion resistance of the aluminum alloy deteriorate.

Chromium, iron, and zirconium refine the recrystallized grains and improve the formability. Zinc enhances the strength without causing the deterioration of formability. Titanium and boron define the cast structure, which in turn leads to improved formability.

Next, the grains and physical properties of the cold-rolled sheet which contains the above-mentioned alloying elements according to the present invention are described. According to research and studies by the present inventors regarding the relationship between crystal-grain diameter and strength and formability, if the average grain diameter is 50 microns or less when measured in the short width direction, the yield strength $_{0.2}$ is approximately 30 kg/mm$^2$ or more; the tensile strength $_B$ is approximately 31 kg/mm$^2$ or more; the earing percentage is approximately 3% or less at 45° in four directions; and the limiting drawing ratio (LDR) is 1.80 or more.

The cold-rolled sheet for forming according to the present invention is superior to conventional ones in the light of the comprehensive properites of formability and strength. In order to obtain properties superior to conventional ones, cold rolling of a rolling degree of at least 30% is necessary. Such a rolling degree is attained by means of cold-rolling the sheet thickness to 0.4 mm or less. In addition, the final finishing condition (the delivery condition) of the cold-rolled sheet for forming is cold-rolling, which is also important for obtaining the properties according to the present invention. The short width direction mentioned above is the direction perpendicular to the rolling direction and parallel to the sheet plane.

The process for producing a cold-rolled sheet for forming is hereinafter explained. First, an aluminum-alloy ingot having a predetermined composition is hot-rolled so as to produce a hot-rolled aluminum-alloy sheet. The hot-rolling conditions are not limited at all. Next, cold-rolling is carried out, if necessary, at an optional working degree.

Subsequently, in order to dissolve the magnesium and silicon in solid solution and to precipitate them as fine compounds, at a later step, especially a low-temperature holding step, a heat-treatment step is carried out.

After this comes the most significant feature of the process according to the present invention, i.e., a final cold-rolling step and a low-temperature holding step, which are hereinafter referred to jointly as the final step. In the final step, the strength of the aluminum alloy is enhanced by cold rolling and the solute magnesium and silicon dissolved in the preceding step(s) are very finely precipitated.

The low-temperature holding step may be carried out simultaneously with the final cold-rolling step. Alternatively, it may be carried out as a separate step before the final cold rolling. In any case, the low-temperature holding step must not be later than the final cold rolling. If the holding at low temperature is carried out not before but after the cold-rolling, the effects due to the cold-work hardening are lost.

Research by the present inventors reveals that precipitates obtained by the final step are much finer than those obtained by cold-rolling followed by annealing, which involves holding at a low temperature. Due to this, the strength and the deep drawing and ironing formabilities are considerably improved.

The numerical limitations for each step will now described.

In the heat-treatment step, a heating temperature of from 400° C. to 580° C. is maintained for a period of 5 minutes or less followed by rapid cooling at a rate of 10° C./second or more down to a temperature of 150° C. or less. If, in the heat-treatment step, the heating temperature is less than 400° C., the dissolution of manganese and the like and the crystal growth will be insufficient. On the other hand, if the heating temperature is more than 580° C., crystal grains of the hot-rolled aluminum-alloy sheet are so likely to coarsen that, even by means of the final cold-rolling, it becomes difficult to obtain a cold-rolled sheet for forming having a predetermined grain size.

Next, if the cooling rate at the temperature range of from 400° C. to 580° C. is more rapid than 10° C./second, it is possible to prevent the manganese and silicon from precipitating as coarse crystals, and to maintain the manganese and silicon in the solute state. The solute manganese and silicon can enhance the softening temperature, such softening occurring when an aluminum-alloy hot- or cold-rolled sheet is exposed to heat. In addition, the crystal grains of a hot-rolled aluminum alloy sheet are refined by means of the rapid cooling of 10° C./second or more, thereby enhancing the heat resistance and formability. If the end temperature of rapid cooling is more than 150° C., the solid-dissolution effects is lost.

In the final cold-rolling step, the rolling degree is 30% or more. If the rolling degree is less than 30%, it is impossible to obtain the strength and grain size of the cold-rolled sheet for forming to be achieved by the present invention.

The aluminum-alloy ingot may be homogenized. While heating the aluminum-alloy ingot at the homogenizing temperature, segregation of the ingot is homogenized, and coarse precipitated manganese compounds are nodularized. The homogenizing temperature is preferably more than 570° C. and the homogenizing time is preferably more than 3 hours. Satisfactory homogenizing would prevent coarse particles, even if the aluminum alloy is exposed to a temperature of 580° C. or slightly less than 580° C. Approximately 80% of the coarse crystallized manganese compounds in an ingot can be nodularized by homogenizing at a temperature of from 580° C. to 610° C. for a period of 8 hours.

Preferable production steps for specific compositions of aluminum-alloy are hereinafter described.

Aluminum Alloy Containing 0.3% to 1.5% Manganese, 0.5% to 2.0% Magnesium, 0.1% to 0.5% Silicon, 0.1% to 0.4% copper, and 0.2% to 0.6% Iron In the hot-rolling, the starting temperature of rolling is from 500° C. to 550° C. and the finishing temperature of rolling is 240° C. or less. This finishing temperature is attained by increasing the temperature drop, for example, by water cooling, from the high temperature (the starting temperature of rolling) to the low temperature (finishing temperature of rolling) during the rolling.

Precipitation of $Mg_2Si$ during the hot-rolling promotes anisotropy of the cold-rolled sheet for forming. Therefore, rapid cooling is effective for suppressing anisotropy. More specifically, the suppression of anisotropy means the percentage of earing formed while subjecting a cold-rolled sheet for forming to deep drawing is kept to 3% or less. In addition, the rapid cooling aims to achieve a quenching effect, that is, dissolving as much $Mg_2Si$ as possible into the solid solution and thus precipitating it at a later stage in a desired manner.

A heat-treatment step is carried out after the hot-rolling. It should be carried out as soon as possible after the hot-rolling so as to suppress the manganese and silicon from precipitating in the form of $Mg_2Si$. The heating temperature (the solutionizing temperature) in the heat-treatment step is a high 500° C. to 580° C., thereby promoting dissolution of silicon, manganese, and the like.

Since the heating temperature is high, grain coarsening of the aluminum-alloy hot-rolled steel sheet is likely to occur, resulting in deteriorated appearance and lowered deep drawing and ironing formabilities. Thus the holding temperature is 5 minutes or less, which makes it possible to provide an aluminum alloy hot-rolled sheet with recrystallization grain size of 70 microns or less. The cooling in the heat treatment step is as rapid as possible, e.g., water cooling or forced cooling, thereby preventing $Mg_2Si$ or $Mg_2Si$—Cu in addition to $Mg_2Si$.

Aluminum Alloy Containing 0.5% to 1.0% Manganese, 1.0% to 2.0% Magnesium, 0.1% to 0.5% Silicon, 0.1% to 0.4% Copper, and 0.3% to 0.7% Iron A homogenizing treatment is carried out at a temperature of from 580° C. to 610° C. for a period of 8 hours or more, followed by air-cooling down to a temperature of from 460° C. to 540° C., and immediately the hot rolling incarried out at said temperature. Due to this air-cooling, the alloying elements, especially magnesium, silicon, and copper, are maintained in a solute state, thereby enhancing the softening temperature of the aluminum-alloy cold-rolled sheet.

The heat-treatment step is carried out to heat the aluminum alloy at a temperature of 400° C. or more for a period of less than 5 minutes, preferably at a temperature of from 400° C. to 550° C. for a period of less than 5 minutes. After the heating, cooling is carried out by water cooling or air cooling. The heat-treatment step may be carried out after the hot rolling such that the retained heat heats the hot-rolled sheet to the heat-treatment temperature. Such heat treatment can be realized when an aluminum-alloy sheet in a strip form is coiled at a high temperature, preferably 300° C. or more, and, if necessary, placing an insulating cover on the coiled aluminum-alloy hot-rolled strip.

In the aluminum-alloy hot-rolled sheet, the aluminum-magnesium-manganese-silicon compounds are precipitated very finely after hot rolling, because the aluminum-alloy is homogenized and the retained heat of the aluminum-alloy hot-rolled sheet promotes the precipitation. Such fine precipitation is enhances the strength and heat resistance (softening temperature) of the finally cold-rolled sheet.

The deformed structure formed by hot rolling is restored and recrystallized during the heat-treatment step, which may therefore be carried out at a low temperature.

Embodiments of the final step are hereinafter described. According to one embodiment, the low-temperature holding step of from 80° C. to 150° C., and the cold-rolling step are carried out separately. In a specific embodiment, the low-temperature holding is carried out first at a temperature of from 80° C. to 150° C., then conventional cold-rolling, in which the temperature of the workpiece does not substantially exceed room temperature, is carried out.

In another specific embodiment, a first cold rolling is carried out in a conventional manner, the low-temperature holding is carried out, at from 80° C. to 150° C., then a second cold rolling is carried out in a conventional manner.

In another specific embodiment, the finishing temperature of cold rolling is from 80° C. to 150° C. Such a finishing temperature can be obtained by either heating a workpiece to a high temperature at the loading side of a cold-rolling mill, heating workpiece between roll stands of a tandem cold-rolling mill, intentionally heavily reducing the size at the rolling passes, finishing the heat treating step at 150° C. and immediately rolling the heat treated workpiece retaining heat, or preheating the rolls.

In another specific embodiment, two of the above-described specific embodiments are combined, so that, for example, low temperature holding at a temperature of from 80° C. to 150° C. is carried out for a period of from 1 to 10 hours, then cold rolling is carried out in such a manner that the finishing temperature is from 80° C. to 150° C.

As is described above, the final cold-rolling may be carried out at a finishing temperature of from 80° C. to 150° C. Such rolling is referred to as a cold-rolling because no recrystallization takes place and only fine precipitation of $Mg_2Si$ and the like takes place.

The cold-rolled sheet for forming according to the present invention is subjected to forming and coating in a conventional manner. When a formed can is subjected to baking of a coating film at a temperature of 250° C. or less, preferably 220° C. or less, the tensile strength may occasionally increase. In addition, when sheet sections of the cold-rolled sheet for forming, cut for example to provide a suitable shape for deep drawing, are heat treated at a temperature of 250° C. or less, preferably 220° C. or less, the tensile strength is maintained or decreases, while the yield strength decreases. As a result, the difference between these strengths increases and the deep drawing and ironing formabilities are improved.

The present invention is now described further with reference to examples.

EXAMPLE 1

Cold-rolled sheets having a thickness of 0.35 mm were produced by using aluminum-alloy ingots having the composition shown in Table 1.

TABLE 1

| No. | | Mn | Mg | Si | Cu | Cr | Fe | Zn | Ti | Al |
|---|---|---|---|---|---|---|---|---|---|---|
| | | (Composition %) (%) | | | | | | | | |
| Invention | 1 | 0.95 | 1.03 | 0.37 | 0.21 | 0.01 | 0.34 | 0.01 | 0.04 | bal |
| | 2 | 0.95 | 1.05 | 0.25 | 0.22 | 0.01 | 0.34 | 0.01 | 0.04 | bal |
| | 3 | 1.01 | 1.10 | 0.18 | 0.32 | 0.04 | 0.33 | 0.01 | 0.04 | bal |
| Comparative Examples | 4 | 1.09 | 1.11 | 0.18 | 0.12 | 0.01 | 0.31 | 0.01 | 0.04 | bal |
| | 5 | 0.96 | 1.07 | 0.24 | 0.23 | 0.20 | 0.32 | 0.01 | 0.04 | bal |

The production steps and conditions of the cold-rolled sheets were as follows.

TABLE 2

| Steps | Production Steps and Conditions: Conditions of invention A | B | C | D | Prior art conditions E |
|---|---|---|---|---|---|
| Homogenizing | 580° C. × 12 hours | | | | |
| Hot-rolling | Initiation: 540° C. Completion: 212° C. to 225° C. (2.5 mmt) | | | | |
| Heat treatment | 550° C. × 3 minutes → Rapid Cooling to less than 100° C. (Approx. 20 seconds) | | | | Intermediate annealing 360° C. × 1 hour |
| Cold-rolling | — | 2.0 mmt (20%) | 1.0 mmt (60%) | — | |
| Heat treatment | 130° C. × 3 hours | | | None | |
| Cold-rolling | 0.35 mmt (86%) | 0.35 mmt (83%) | 0.35 mmt (65%) | Rolling (Finishing temperature) (130° C.) 0.35 mmt (86%) | 0.35 mmt (86%) |

In conditions A through D, the maximum grain size of recrystallized grains was 50 microns when the hot-deformed crystals recrystallized during the heat-treatment step and the workpiece was rapidly cooled after heating. In condition E, the maximum grain-size of recrystallized grains after the intermediate annealing was 40 microns.

The average diameter of crystal grains in the short width direction of composition No. 2 of the present invention after completion of final annealing was measured. The measured results are shown in Table 3.

TABLE 3

| Average Diameter of Crystal Grains in Short Width Direction (microns): Conditions of invention A | B | C | D | Prior art conditions E |
|---|---|---|---|---|
| 45 | 45 | 50 | 45 | 60 |

The cold-rolled sheets for forming produced under the conditions given in Table 2 had the yield strength $\sigma_{0.2}$, tensile strength $\sigma_B$, elongation $\delta$, earing percentage, Erichsen value (EV), and LDR as shown in Tables 4 through 8.

TABLE 4

| Alloy Composition 1 (Invention) Conditions | Yield strength $\sigma_{0.2}$ (kg/mm$^2$) | Tensile strength $\sigma_B$ (kg/mm$^2$) | Elongation $\delta$ (%) | Earing percentage 45°-four direction (%) | EV (mm) | LDR |
|---|---|---|---|---|---|---|
| A | 32.9 | 33.5 | 3 | 3.0 | 4.5 | 1.85 |
| B | 34.0 | 35.2 | 2 | 2.7 | 4.3 | 1.80 |
| C | 34.5 | 35.5 | 2 | 2.9 | 4.4 | 1.80 |
| D | 31.7 | 32.5 | 3 | 3.1 | 4.5 | 1.85 |
| E | 28.9 | 30.0 | 2 | 2.7 | 4.4 | 1.85 |

TABLE 5

| Alloy Composition 2 (Invention) Conditions | Yield strength $\sigma_{0.2}$ (kg/mm$^2$) | Tensile strength $\sigma_B$ (kg/mm$^2$) | Elongation $\delta$ (%) | Earing percentage 45°-four direction (%) | EV (mm) | LDR |
|---|---|---|---|---|---|---|
| A | 31.2 | 31.6 | 2 | 3.0 | 4.4 | 1.90 |
| B | 32.2 | 32.7 | 2 | 2.9 | 4.8 | 1.85 |
| C | 32.5 | 33.0 | 2 | 2.9 | 4.4 | 1.80 |
| D | 30.6 | 31.1 | 2 | 2.7 | 4.2 | 1.90 |
| E | 28.6 | 29.5 | 2 | 3.0 | 4.5 | 1.90 |

TABLE 6

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 3 (Invention) | | | | | |
| A | 31.4 | 31.8 | 2 | 2.7 | 4.4 | 1.85 |
| B | 32.3 | 32.7 | 2 | 2.9 | 4.3 | 1.85 |
| C | 32.4 | 33.0 | 2 | 3.1 | 4.3 | 1.80 |
| D | 31.0 | 31.5 | 2 | 2.8 | 4.4 | 1.85 |
| E | 29.0 | 29.9 | 2 | 2.7 | 4.5 | 1.85 |

TABLE 7

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 4 (Comparative Examples) | | | | | |
| A | 29.4 | 30.1 | 1 | 2.7 | 4.2 | 1.85 |
| B | 30.0 | 30.8 | 1 | 3.0 | 4.2 | 1.85 |
| C | 30.4 | 31.0 | 1 | 3.1 | 4.4 | 1.80 |
| D | 29.3 | 30.3 | 2 | 2.7 | 4.4 | 1.90 |
| E | 28.6 | 29.4 | 2 | 3.0 | 4.5 | 1.85 |

TABLE 8

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 5 (Comparative Examples) | | | | | |
| A | 29.2 | 29.8 | 1 | 2.8 | 4.4 | 1.85 |
| B | 30.1 | 30.7 | 1 | 2.7 | 4.3 | 1.85 |
| C | 30.4 | 31.0 | 1 | 2.7 | 4.4 | 1.80 |
| D | 28.7 | 29.2 | 1 | 3.0 | 4.5 | 1.85 |
| E | 28.4 | 29.0 | 2 | 3.0 | 4.5 | 1.85 |

As is apparent from Tables 4 through 8, the cold-rolled sheets for forming according to the present invention exhibit an earing percentage, EV, and elongation equivalent to those of the cold-rolled sheet for forming having the conventional composition and/or produced under condition E. However, the strength of the cold-rolled sheets for forming according to the present invention is high. High copper and low chromium compositions are effective for enhancing the strength.

The produced cold-rolled sheets were subjected to deep drawing and ironing so as to form the drum of DI cans. Conventionally, an alloy having composition 4 is formed under condition E so as to produce a drum of DI cans, and the ironing formability and the sticking resistance to tools are good. The cold-rolled sheets of the present invention exhibit similarly good results as in the combination of composition 4 and condition E.

The above described cold-rolled sheets were heat-treated at 185° C. for 20 minutes, and then tested. The test results are shown in Tables 9 through 13.

TABLE 9

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 1 | | | | | |
| A | 31.6 | 34.8 | 6 | 3.1 | 5.0 | 2.00 |
| B | 33.2 | 36.3 | 6 | 2.9 | 4.9 | 1.95 |
| C | 33.5 | 36.4 | 6 | 2.9 | 4.9 | 2.00 |
| D | 31.4 | 34.5 | 7 | 3.0 | 5.1 | 2.05 |
| E | 26.5 | 28.7 | 7 | 2.8 | 5.0 | 2.00 |

TABLE 10

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 2 | | | | | |
| A | 29.5 | 32.7 | 7 | 2.8 | 5.2 | 2.05 |
| B | 30.5 | 33.6 | 7 | 2.9 | 5.3 | 2.00 |
| C | 31.3 | 34.0 | 6 | 3.0 | 5.0 | 2.00 |
| D | 29.5 | 32.8 | 6 | 2.9 | 5.0 | 2.00 |

TABLE 10-continued

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 2 | | | | | |
| E | 26.7 | 28.8 | 7 | 3.0 | 5.2 | 2.00 |

TABLE 11

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 3 | | | | | |
| A | 30.0 | 32.6 | 7 | 2.8 | 5.2 | 2.05 |
| B | 30.8 | 33.5 | 7 | 3.1 | 5.2 | 2.05 |
| C | 31.0 | 34.1 | 7 | 3.0 | 5.1 | 2.00 |
| D | 30.2 | 32.6 | 7 | 2.8 | 5.0 | 2.00 |
| E | 27.1 | 28.7 | 8 | 2.6 | 5.2 | 2.00 |

TABLE 12

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 4 | | | | | |
| A | 28.7 | 30.8 | 7 | 2.7 | 5.1 | 2.00 |
| B | 29.0 | 31.1 | 7 | 2.8 | 5.3 | 2.00 |
| C | 29.1 | 31.7 | 7 | 3.0 | 5.1 | 1.95 |
| D | 28.4 | 30.6 | 7 | 2.7 | 5.2 | 2.00 |
| E | 26.1 | 28.1 | 7 | 3.1 | 5.2 | 2.00 |

TABLE 13

| Conditions | Yield strength $\sigma_{0.2}$ (kg/mm$^2$) | Tensile strength $\sigma_B$ (kg/mm$^2$) | Elongation δ (%) | Earing percentage 45°-four direction (%) | EV (mm) | LDR |
|---|---|---|---|---|---|---|
| | Alloy Composition 5 | | | | | |
| A | 28.4 | 30.1 | 7 | 2.8 | 5.1 | 2.00 |
| B | 29.1 | 30.9 | 6 | 2.6 | 5.0 | 2.00 |
| C | 29.2 | 31.8 | 7 | 2.7 | 5.2 | 2.00 |
| D | 27.8 | 30.7 | 7 | 3.1 | 5.1 | 2.00 |
| E | 26.5 | 28.8 | 8 | 2.5 | 5.2 | 2.00 |

As is apparent from Tables 9 through 13, the final heat treatment, which is carried out when the cold-rolled sheets are cut into sections or when the coating is baked, slightly decreases the yield strength and increases the elongation. No change in sticking resistance to tools occurred due to the final heat treatment.

In condition D, the cold rolling was carried out under the following conditions. The starting temperature of rolling was 50° C. or less. The cold-reduction of thickness of from 2.5 mm to 0.9 mm was carried out in one rolling pass, and the finishing temperature of rolling was 120° C. The temperature of the workpiece was decreased from 120° C. to 50° C. or less, and then the cold-reduction of thickness of from 0.5 mm to 0.35 mm was carried out in one pass. The finishing temperature of rolling was 130° C. A tandem mill was used rolling.

EXAMPLE 2

Cold-rolled sheets were produced using the compositions given in Table 14 by the process and conditions given in Table 15.

TABLE 14

| No. | Mn | Mg | Si | Cu | Cr | Fe | Zn | Ti | Al |
|---|---|---|---|---|---|---|---|---|---|
| | (Composition %) | | | | | | | | |
| 6 | 0.35 | 0.60 | 0.19 | 0.15 | 0.01 | 0.43 | 0.05 | 0.03 | bal |
| 7 | 0.37 | 1.95 | 0.18 | 0.16 | 0.01 | 0.45 | 0.05 | 0.03 | bal |
| 8 | 1.38 | 0.62 | 0.20 | 0.16 | 0.01 | 0.42 | 0.04 | 0.03 | bal |
| 9 | 1.42 | 1.90 | 0.19 | 0.15 | 0.01 | 0.43 | 0.04 | 0.03 | bal |

TABLE 15

| Steps | Production Steps and Conditions: Conditions of invention F | Conditions of invention G | Prior art conditions H |
|---|---|---|---|
| Homogenizing | 580° C. × 10 hours → Furnace cooling to 540° C. | | |
| Hot-rolling | Initiation: 540° C. (2.5 mmt) | | |
| Heat treatment | 565° C. × 20 seconds → less than 100 ° C. (approx. 20 seconds) | | Intermediate annealing |

TABLE 15-continued

| Steps | Production Steps and Conditions: Conditions of invention F | Conditions of invention G | Prior art conditions H |
|---|---|---|---|
| Cold-rolling | — | 0.7 mmt | 360° C. × 1 hour |
| Heat treatment | | 110° C. × 8 hours | |
| Cold-rolling | Rolling (Finishing temperature 100° C.) 0.35 mmt (86%) | 0.35 mmt (50%) | 0.35 mmt (86%) |

The cold-rolled sheets for forming, having the compositions 6 and 9 and produced under the conditions F, G, and H were measured for average grain diameter in the short width direction. The results are given in Table 16.

TABLE 16

| Alloy composition | Average Diameter of Crystal Grains in Short Width Direction (microns): Processes of invention F | Processes of invention G | Prior art processes H |
|---|---|---|---|
| 6 | 25 | 30 | 60 |
| 9 | 25 | 30 | 60 |

The cold-rolled sheets for forming produced under Table 15 had the yield strength $\sigma_{0.2}$, tensile strength $\sigma_B$, elongation $\delta$(%), earing percentage, EV, and LDR as shown in Table 17.

TABLE 17

| Alloy | Processes | Yield strength $\sigma_{0.2}$ (kg/mm$^2$) | Tensile strength $\sigma_B$ (kg/mm$^2$) | Elongation $\delta$ (%) | EV (mm) | LDR | Earing percentage 45°-four direction (%) |
|---|---|---|---|---|---|---|---|
| 6 | Invention F | 25.9 | 26.7 | 2 | 4.6 | 2.05 | 2.7 |
| | Invention G | 25.0 | 27.2 | 3 | 4.9 | 2.05 | 3.1 |
| | Comparative example H | 24.2 | 25.2 | 3 | 4.8 | 2.00 | 3.0 |
| 7 | Invention F | 33.3 | 33.8 | 2 | 4.6 | 1.90 | 2.0 |
| | Invention G | 32.7 | 34.1 | 3 | 4.9 | 1.90 | 2.0 |
| | Comparative example H | 31.2 | 32.1 | 2 | 4.5 | 1.90 | 1.5 |
| 8 | Invention F | 30.1 | 30.5 | 2 | 4.7 | 1.90 | 3.6 |
| | Invention G | 29.7 | 31.3 | 2 | 4.8 | 1.95 | 3.5 |
| | Comparative example H | 28.5 | 28.8 | 2 | 4.7 | 1.90 | 3.7 |
| 9 | Invention F | 38.0 | 38.2 | 1 | 4.5 | 1.80 | 3.6 |
| | Invention G | 37.9 | 39.0 | 2 | 4.7 | 1.80 | 3.9 |
| | Comparative example H | 36.1 | 36.1 | 1 | 4.4 | 1.80 | 4.0 |

As is apparent from Table 17, the EV, LDR, and earing percentage obtained by the present invention are equivalent to those of the prior art, while the strength achieved by the present invention is higher.

EXAMPLE 3

Cold-rolled sheets were produced using the composition as shown in Table 18 and under the conditions given in Table 19.

TABLE 18

| No. | Si | Fe | Cu | Mn | Mg | Cr | Zr | Ti | Al |
|---|---|---|---|---|---|---|---|---|---|
| | (Composition %) | | | | | | | | |
| 10 (Comparative example) | 0.08 | 0.32 | 0.01 | 0.41 | 1.40 | 0.01 | 0.01 | 0.04 | bal |
| 11 (Invention) | 0.20 | 0.35 | 0.10 | 1.00 | 1.25 | 0.01 | 0.01 | 0.04 | bal |

TABLE 19

| Steps | Production Steps and Conditions: Conditions of invention I | Prior art conditions J |
|---|---|---|
| Homogenizing | 590° C. × 8 hours → 500° C. by air-cooling | 580° C. × 8 hours |
| Hot-rolling | Initiation: 500° C. | Initiation: 540° C. |
| Heat treatment | Completion: 298° C. (2.5 mmt) 450° C. × 30 seconds → 120° C. by air-cooling (more than 10° C./sec) | Completion: 302° C. (2.5 mmt) Temperature elevation up to 360° C. in 12 hours, holding at 360° C. for 1 hour and cooling in 9 hours |
| Cold-rolling | 0.35 mmt (Finishing temperature 90° C.) | 0.35 mmt |

The properties of the produced cold-rolled sheets were measured. The measured results are shown in Table 20.

TABLE 20

| Processes | Composition | Yield strength $\sigma_{0.2}$ (kg/mm$^2$) | Tensile strength $\sigma_B$ (kg/mm$^2$) | Elongation $\delta$ (%) | EV (mm) | LDR | Earing percentage 45°-four direction (%) | Average diameter of crystal grains in short width direction of cold-rolled sheet (microns) |
|---|---|---|---|---|---|---|---|---|
| I | 10 | 27.8 | 28.5 | 2 | 4.8 | 2.00 | 2.5 | 20 |

TABLE 20-continued

| Processes | Composition | Yield strength $\sigma_{0.2}$ (kg/mm$^2$) | Tensile strength $\sigma_B$ (kg/mm$^2$) | Elongation δ (%) | EV (mm) | LDR | Earing percentage 45°-four direction (%) | Average diameter of crystal grains in short width direction of cold-rolled sheet (microns) |
|---|---|---|---|---|---|---|---|---|
| | 11 | 29.8 | 30.8 | 2 | 4.6 | 1.95 | 2.7 | 20 |
| J | 10 | 26.8 | 27.3 | 2 | 4.5 | 1.95 | 2.2 | 65 |
| | 11 | 28.8 | 29.5 | 2 | 4.2 | 1.85 | 3.0 | 60 |

As is apparent from Table 20, a cold-rolled sheet according to the present invention (Process I and Composition 11) has higher yield strength and tensile strength and greater difference in these strengths than in other cold-rolled sheets. In addition, a cold-rolled sheet according to the present invention has fine grains. Therefore the cold-drawability of the cold-rolled sheet is excellent.

A cold-rolled sheet according to a comparative example (Process I and Composition 11) has low yield strength and tensile strength because of low silicon content and the process.

The cold-rolled sheets were heat treated at 185° C. for 20 minutes and then the properties were measured. The measured results are shown in Table 21. In addition, the cold-rolled sheets were heat treated at 240° C. for 10 minutes and the properties measured. The measured results are shown in Table 22.

As is apparent from Table 21 and Table 22, a decrease in strength, increase in elongation, and increase in EV and LDR occur due to the heat treatment. This results from the fact that during heat treatment in condition I, air cooling is carried out.

A combination of condition I and composition 11 can attain overall properties superior to others.

EXAMPLE 4

Cold-rolled sheets were produced using the composition given in Table 23 and under conditions given in Table 24.

TABLE 21

| Processes | Composition | Yield strength $\sigma_{0.2}$ (kg/mm$^2$) | Tensile strength $\sigma_B$ (kg/mm$^2$) | Elongation δ (%) | EV (mm) | LDR | Earing percentage 45°-four direction (%) |
|---|---|---|---|---|---|---|---|
| I | 10 | 25.2 | 27.0 | 9 | 5.5 | 2.10 | 2.4 |
| | 11 | 27.5 | 29.6 | 8 | 5.3 | 3.10 | 2.6 |
| J | 10 | 24.5 | 26.1 | 7 | 5.0 | 2.05 | 2.5 |
| | 11 | 26.2 | 28.3 | 6 | 4.8 | 1.95 | 3.1 |

TABLE 22

| Processes | Composition | Yield strength $\sigma_{0.2}$ (kg/mm$^2$) | Tensile strength $\sigma_B$ (kg/mm$^2$) | Elongation δ (%) | EV (mm) | LDR | Earing percentage 45°-four direction (%) |
|---|---|---|---|---|---|---|---|
| I | 10 | 24.5 | 26.2 | 10 | 6.0 | 2.15 | 2.5 |
| | 11 | 26.5 | 28.5 | 9 | 5.8 | 2.15 | 2.6 |
| J | 10 | 22.0 | 24.4 | 10 | 5.8 | 2.10 | 2.4 |
| | 11 | 24.0 | 26.1 | 10 | 5.8 | 2.10 | 3.0 |

TABLE 23

| | (Composition %) | | | | | | | | |
|---|---|---|---|---|---|---|---|---|---|
| No. | Mn | Mg | Si | Cu | Cr | Fe | Zn | Ti | Al |
| 12 | 0.55 | 1.09 | 0.26 | 0.15 | 0.02 | 0.37 | 0.03 | 0.03 | bal |
| 13 | 0.56 | 1.60 | 0.24 | 0.14 | 0.01 | 0.35 | 0.04 | 0.03 | bal |
| 14 | 0.53 | 1.96 | 0.25 | 0.33 | 0.03 | 0.62 | 0.05 | 0.04 | bal |

TABLE 23-continued

| | (Composition %) | | | | | | | | |
|---|---|---|---|---|---|---|---|---|---|
| No. | Mn | Mg | Si | Cu | Cr | Fe | Zn | Ti | Al |
| 15 | 0.70 | 1.25 | 0.38 | 0.20 | 0.02 | 0.49 | 0.01 | 0.03 | bal |
| 16 | 0.75 | 1.52 | 0.15 | 0.27 | 0.01 | 0.54 | 0.03 | 0.03 | bal |
| 17 | 0.69 | 1.95 | 0.19 | 0.16 | 0.02 | 0.50 | 0.05 | 0.04 | bal |
| 18 | 0.96 | 1.07 | 0.26 | 0.30 | 0.01 | 0.42 | 0.02 | 0.03 | bal |
| 19 | 0.98 | 1.47 | 0.20 | 0.15 | 0.02 | 0.39 | 0.01 | 0.03 | bal |
| 20 | 0.94 | 1.94 | 0.22 | 0.19 | 0.02 | 0.55 | 0.06 | 0.04 | bal |

TABLE 24

| | Production Steps and Conditions | | |
|---|---|---|---|
| | Conditions of invention | | Prior art conditions |
| Steps | K | L | M |
| Homogenizing | 580° C. × 10 hours → 540° C. × 4 hours | | |
| Hot-rolling | 5.0 mmt | | |
| Intermediate annealing | 360° C. × 30 minutes | | |
| Cold-rolling | 3.0 mmt | | |
| Heat treatment | 550° C. × 30 seconds → Water cooling (Approx. 100° C./second) | | Annealing 400° C. × 1 hour |
| Cold-rolling | Rolling (Finishing temperature 120° C.) 1.5 mmt (50%) | 1.5 mmt (50%) | 1.5 mmt (50%) |
| Heat treatment | — | 140° C. × 1 hour | — |
| Cold-rolling | — | Under condition heated at 140° C. and by preheated rolling rolls 0.30 mmt (80%) (Finishing temperature 140° C.) | 0.30 mmt (80%, in total 90%) |

The properties of 1.5 mm thick cold-rolled sheets obtained under the above described conditions are shown in Table 25.

TABLE 25

| Composition | Processes | Yield strength $\sigma_{0.2}$ (kg/mm$^2$) | Tensile strength $\sigma_B$ (kg/mm$^2$) | Elongation $\delta$ (%) | Earing percentage 45°-four direction (%) | EV (mm) | LDR |
|---|---|---|---|---|---|---|---|
| 12 | K | 22.2 | 23.0 | 6 | 1.4 | 6.6 | 2.05 |
| | M | 20.9 | 21.8 | 6 | 1.6 | 6.4 | 2.05 |
| 13 | K | 25.0 | 25.5 | 6 | 1.8 | 6.2 | 2.00 |
| | M | 23.3 | 24.2 | 5 | 2.0 | 6.2 | 2.00 |
| 14 | K | 26.8 | 27.5 | 6 | 2.0 | 6.3 | 2.00 |
| | M | 25.8 | 26.7 | 6 | 1.8 | 6.2 | 2.00 |
| 15 | K | 27.1 | 27.9 | 5 | 2.0 | 6.0 | 2.00 |
| | M | 24.5 | 25.3 | 5 | 2.2 | 6.3 | 2.00 |
| 16 | K | 26.7 | 27.5 | 5 | 1.8 | 6.2 | 2.00 |
| | M | 25.0 | 26.1 | 5 | 2.0 | 6.1 | 2.00 |
| 17 | K | 28.0 | 28.6 | 6 | 2.2 | 6.3 | 2.00 |
| | M | 26.7 | 27.5 | 5 | 1.8 | 6.2 | 1.95 |
| 18 | K | 24.2 | 25.0 | 5 | 1.8 | 5.4 | 2.00 |
| | M | 22.5 | 23.9 | 6 | 1.8 | 5.6 | 2.05 |
| 19 | K | 26.0 | 26.7 | 6 | 2.0 | 5.8 | 2.00 |
| | M | 25.6 | 26.3 | 6 | 1.6 | 5.8 | 2.00 |
| 20 | K | 29.0 | 29.9 | 5 | 1.8 | 5.4 | 1.95 |
| | M | 28.2 | 28.6 | 5 | 2.0 | 5.5 | 1.95 |

As is apparent from Table 25, when, under condition M, heat treatment is carried out for a long time and conventional cold-rolling is carried out without holding the workpiece at a low temperature, the yield strength and tensile strength of the cold-rolled sheets become low. The formability obtained under condition M is deemed to be at least equivalent to that obtained under condition K (present invention), when the EV and LDR drawing ratio are used in combination as the basis for evaluating the formability.

The properties of 0.30 mm thick cold-rolled sheets obtained by the process steps shown in Table 24 are shown in Table 26.

TABLE 26

| Composition | Processes | Yield strength $\sigma_{0.2}$ (kg/mm$^2$) | Tensile strength $\sigma_B$ (kg/mm$^2$) | Elongation $\delta$ (%) | Earing percentage 45°-four direction (%) | EV (mm) | LDR |
|---|---|---|---|---|---|---|---|
| 12 | L | 30.1 | 30.9 | 3 | 2.7 | 4.7 | 1.85 |
| | M | 26.4 | 27.6 | 3 | 2.5 | 4.6 | 1.85 |
| 13 | L | 32.8 | 33.6 | 3 | 2.8 | 4.6 | 1.85 |
| | M | 29.3 | 29.8 | 2 | 3.0 | 4.6 | 1.85 |
| 14 | L | 37.5 | 38.0 | 2 | 3.0 | 4.4 | 1.80 |
| | M | 33.0 | 33.5 | 2 | 2.8 | 4.4 | 1.85 |
| 15 | L | 38.0 | 38.8 | 2 | 3.1 | 4.4 | 1.75 |
| | M | 32.0 | 32.6 | 3 | 3.1 | 4.5 | 1.85 |
| 16 | L | 35.6 | 36.2 | 2 | 2.8 | 4.4 | 1.80 |
| | M | 32.4 | 32.7 | 2 | 3.0 | 4.6 | 1.85 |
| 17 | L | 36.4 | 37.0 | 2 | 2.6 | 4.3 | 1.80 |
| | M | 33.7 | 34.2 | 2 | 3.1 | 4.6 | 1.80 |
| 18 | L | 32.7 | 33.2 | 3 | 3.0 | 4.5 | 1.85 |
| | M | 29.5 | 30.3 | 2 | 2.7 | 4.8 | 1.85 |
| 19 | L | 33.9 | 34.7 | 3 | 2.4 | 4.6 | 1.85 |
| | M | 31.0 | 32.1 | 2 | 2.5 | 4.7 | 1.85 |
| 20 | L | 37.0 | 37.8 | 2 | 2.7 | 4.4 | 1.75 |
| | M | 34.9 | 35.1 | 2 | 3.1 | 4.5 | 1.80 |

A comparison of Table 26 and Table 25 shows changes in the properties due to the double-stage cold-rolling.

The cold-rolled sheets according to the present invention (L) have higher yield strength and tensile strength and equivalent earing percentage, EV, and LDR compared with comparative example (M).

Alminum alloys of compositions 12, 15, 18, and 19 were measured after the final cold-rolling for average grain size in the short width direction of the cold-rolled sheet. The measured results are shown in Table 27.

TABLE 27

| Alloy composition | Average Diameter of Crystal Grains in Short Width Direction (microns) | | |
|---|---|---|---|
| | Processes of invention | | Prior art Processes |
| | K | L | M |
| 1 | 35 | 30 | 65 |
| 4 | 35 | 30 | 65 |
| 7 | 35 | 30 | 65 |
| 8 | 35 | 30 | 65 |

As is apparent from Table 27, the average diameter of crystal grains in short width direction is smaller in double cold-rolling of the porcess L than in the single cold-rolling of process K. Although the double-cold rolling is carried out in the prior art processes M, since the heat-treatment is a long-time annealing, the crystal grains coarsen during the annealing and cannot be fine by a subsequent cold rolling. Therefore, the average diameter of crystal grains in the short width direction is large in the prior art processes M.

It will be understood from the above descriptions that the present invention attain production of a DI can having a thin wall and saving natural resources.

We claim:

1. A process for producing an aluminum-alloy cold-rolled sheet for forming, which comprises the steps of:

(a) hot-rolling an aluminum-alloy ingot which consists essentially of from 0.1% to 2.0% manganese, from 0.1% to 2.0% magnesium, and from 0.1% to 0.5% silicon;

(b) heat-treating the resulting aluminum-alloy sheet at a temperature of from 400° C. to 580° C. for a period of 5 minutes or less, followed by rapid cooling of the sheet at a rate of 10° C. per second or more down to a temperature of 150° C. or less;

(c) holding the aluminum alloy sheet at a temperature of from 80° C. to 150° C. to form finely divided precipitates therein; and (d) cold-rolling said sheet at a rolling degree of 30% or more;

said holding step (c) taking place after the heat-treating step (b) but not after the cold-rolling step (d).

2. A process for producing a cold-rolled aluminum-alloy sheet for forming, which comprises the steps of:

(a) hot-rolling an aluminum-alloy ingot which consists essentially of from 0.1% to 2.0% manganese, from 0.1% to 2.0% magnesium, and from 0.1% to 0.5% silicon;

(b) heat-treating the aluminum-alloy sheet at a temperature of from 400° C. to 580° C. for a period of 5 minutes or less, followed by rapid cooling at a rate of 10° C. per second or more down to a temperature of 150° C. or less;

(c) holding the aluminum-alloy sheet at a temperature of from 80° C. to 150° C. to form finely divided precipitates therein;

(d) final cold-rolling said sheet at a rolling degree of 30% or more; and (e) heating said final cold-rolled sheet to a temperature of 250° C. or less;

said holding step (c) taking place after the heat-treating step (b) but not after the final cold-rolling step (d).

3. A process according to claim 1, wherein the aluminum alloy consists essentially of from 0.3% to 1.5% manganese, from 0.5% to 2.0% magnesium, from 0.1% to 0.5% silicon, from 0.1% to 0.4% copper, and from 0.2% to 0.6% iron and the aluminum alloy is heated to a temperature of from 500° C. to 580° C. in said heat-treatment step (b).

4. A process according to claim 1, wherein in the hot-rolling step (a), the starting temperature of rolling is from 500° C. to 550° C. and the finishing temperature of rolling is 240° C. or less.

5. A process according to claim 1, wherein the aluminum alloy consists essentially of from 0.5% to 1.0% manganese, from 1.0% to 2.0% magnesium, from 0.1% to 0.5% silicon, from 0.1% to 0.4% copper, and from 0.3% to 0.7% iron and the aluminum alloy is heated to a temperature of from 400° C. to 550° C. in the heat treatment step (b).

6. A process according to claim 5, wherein said aluminum-alloy ingot is homogenized and then cooled to a temperature of from 460° C. to 540° C., and the hot rolling step (a) is initiated at a temperature of from 460° C. to 540° C. when said cooling is completed.

* * * * *